US006542123B1

(12) United States Patent
Chen

(10) Patent No.: US 6,542,123 B1
(45) Date of Patent: Apr. 1, 2003

(54) HIDDEN WIDEBAND ANTENNA

(75) Inventor: I-Fong Chen, Tao-Yuan (TW)

(73) Assignee: Auden Techno Corp., TaoYuan Hsien (TW)

( * ) Notice: Subject to any disclaimer, the term of this patent is extended or adjusted under 35 U.S.C. 154(b) by 0 days.

(21) Appl. No.: 09/983,313

(22) Filed: Oct. 24, 2001

(51) Int. Cl.[7] ..... H01Q 1/38

(52) U.S. Cl. ..... 343/700 MS; 343/702; 343/767; 343/846

(58) Field of Search ..... 343/700 MS, 702, 343/846, 848, 725, 767, 850, 829

(56) References Cited

U.S. PATENT DOCUMENTS 5,644,319 A * 7/1997 Chen et al. ..... 343/702
5,943,020 A * 8/1999 Liebendoerfer et al. .... 343/702
6,114,996 A * 9/2000 Nghiem ..... 343/700 MS
6,268,831 B1 * 7/2001 Sanford ..... 343/702
6,346,914 B1 * 2/2002 Annamaa ..... 343/700 MS
6,380,905 B1 * 4/2002 Annamaa et al. ..... 343/767
6,408,190 B1 * 6/2002 Ying ..... 455/553
6,448,932 B1 * 9/2002 Stoiljkovic et al. .. 343/700 MS
6,456,249 B1 * 9/2002 Johnson et al. ..... 343/702
6,483,462 B2 * 11/2002 Weinberger ..... 343/700 MS

* cited by examiner

*Primary Examiner*—Don Wong
*Assistant Examiner*—Shih-Chao Chen
(74) *Attorney, Agent, or Firm*—Troxell Law Office PLLC

(57) ABSTRACT

A hidden wideband antenna which is provided with an integrally shaped metal sheet, the metal sheet is provided with an open slot with a predetermined length on the main sheet thereof to partition it into a long section and a short section both of a partial wavelength respectively of multi-resonance frequencies, a signal feed-in contact piece and a grounding contact piece are provided at one corner of the main sheet by punching; an inwardly recessed section is provided along the long section to form a U-shape space, and a bent back section bent upwardly is provided at the outermost edge of the long section, the bent back section is provided with a protruding portion facing to the U-shape space of the inwardly recessed section to function as an open stub for adjusting the frequency matching and increasing the bandwidth of the hidden antenna.

3 Claims, 5 Drawing Sheets

| 1: MKr (MHz) | | 2: MKr (MHz) dB |
|---|---|---|
| 1: 880.0000 | 2.538 | |
| 2: 960.0000 | 2.246 | |
| 3: 1710.0000 | 1.350 | |
| 4: 1880.0000 | 2.154 | |

HIDDEN WIDEBAND ANTENNA

BACKGROUND OF THE INVENTION

1. Field of the Invention

The present invention is related to a hidden wideband antenna, and especially to a modified PIFA (planar inverted F-antenna) of which an open stub is provided to adjust electric matching and increase bandwidth.

2. Description of the Prior Art

A helix antenna of which the spiral coil is formed by winding metallic wires is the major type of antenna. Any of the followings including the diameter or the material of a coil or the pitch between rings of a coil or the total length of a coil of this kind of helix antenna will affect the set function in every aspect. But the defect of such conventional helix antenna resides in three-dimensional protruding out of the equipment. As for communication equipment of the modern miniaturized type or with necessary built-in antennas (such as a mobile phone or a portable computer), it can hardly be surely desirable.

Thus, various miniaturized and planar hidden microstrip antennas were gradually researched and developed. Among the modern applicable embodiments of the planar antennas, the relatively notable one is the planar inverted F-antenna (PIFA). In an early common planar inverted F-antenna as shown in FIG. 1, a metal wire 11 is provided on a grounding surface 10, a short point 12 is provided on one end of the metal wire 11, and a feed point 13 is provided near the short point 12, the feed point 13 is connected to a feed-in axle 14. A desired single-frequency antenna can be formed in this way. This early type inverted F-antenna can be developed to get a planar inverted F-antenna as shown in FIG. 2. Basically it includes a metal surface 15 of a predetermined area, and other related items including a grounding surface 100, a short point 120, a feed point 130 and a feed-in axle 140.

It was stated in "Dual-Frequency PIFA" on page 1451 of "IEEE" published in October of 1997 that, either to merge two separate blocks of different sizes into a rectangular shape or to directly provide an open slot with two mutually perpendicular sections on a rectangular metal surface can form a desired dual frequency PIFA.

Furthermore, a modified planar inverted F-antenna (PIFA) is researched and developed in recent years, which allows further diminishing of the PIFA size to make the antenna length be smaller than ⅛ wavelength (λ) and the antenna height be smaller than 0.01 wavelength (λ), and to have a larger bandwidth ("ELECTRONICS LETTERS", Jan. 8, 1998, Vol.34 No.1). But the bandwidth is still low in application, and it is hard to be adapted to the modern hidden antennas of dual or multi-frequencies in a more desirable way.

SUMMARY OF THE INVENTION

The object of the present invention is to provide a hidden wideband antenna which is provided on a metal sheet with an open slot to partition it into a long section and a short section. The long and the short sections are both set to have a partial wavelength respectively of multi-resonant frequencies. An inwardly recessed section is provided at a specific position along the long section, and a bent back section is provided on the long section. The bent back section is provided with a protruding portion facing to the inwardly recessed portion and spaced therefrom with a predetermined distance in order to form an open stub to adjust frequency matching and increase bandwidth. This is the prime motive for the present invention.

The present invention will be apparent in its novelty and other features after reading the detailed description of the preferred embodiment thereof in reference to the accompanying drawings.

DETAILED DESCRIPTION OF THE PREFERRED EMBODIMENT

Figure 4:
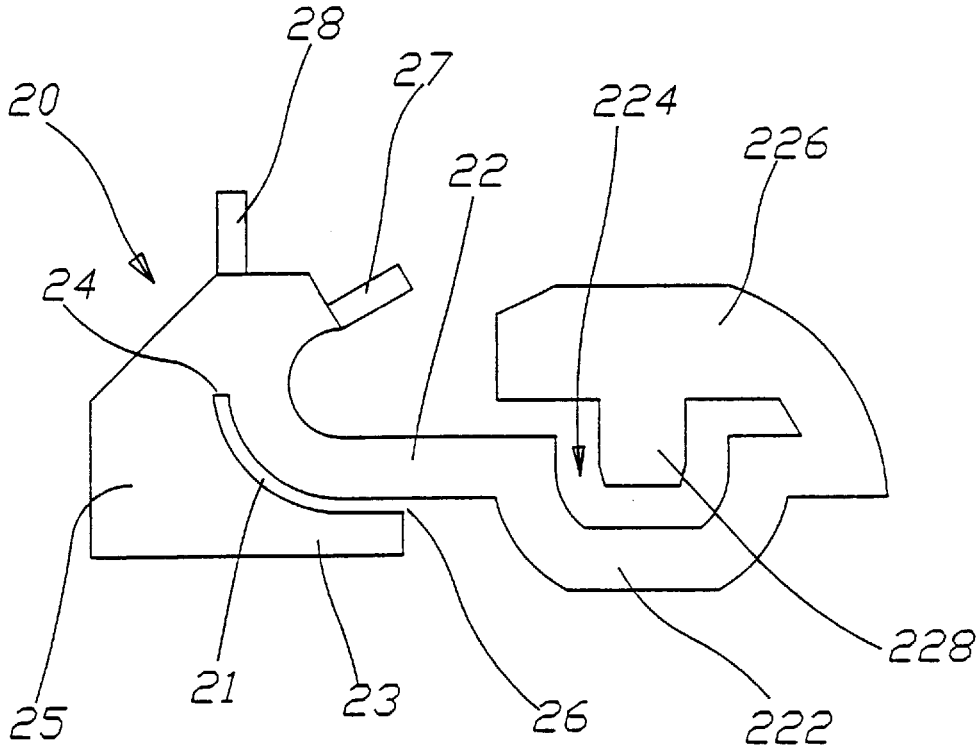
FIG. 4 is a top view showing the unfolded state of FIG. 3.

Referring to FIG. 4 firstly, the present invention can be shaped integrally with an appropriate metal sheet material by punching. The metal sheet 20 is provided with an open slot 21 to partition it into a long section 22 and a short section 23 to thereby form a desired dual- or multi-frequency antenna. In the embodiment as shown in the drawing, the open slot 21 is an arc slot with one end 24 closed at a proper location on the left side of the main sheet 25, and with the other end 26 opened to the outside at one lateral side of the main sheet 25. In this way, the long section 22 and the short section 23 of partial wavelengths in different lengths of resonance frequencies are obtained by partitioning. And a signal feed-in contact piece 27 and a grounding contact piece 28 can be provided at one corner of the main sheet 25 by punching at the same time.

The prime feature of the present invention is to provide an inwardly recessed section 222 in order to form a U-shaped space 224 along the long section 22, and to form a bent back section 226 bent upwardly at the outermost edge of the long section 22 at the same time. A protruding portion 228 facing to the U-shape space 224 of the inwardly recessed section 222 is provided on the bent back section 226. The protruding portion 228 is kept a predetermined distance from the inwardly recessed section 222 and extends into the U-shape space 224. In the preferred embodiment as shown in the drawing, the protruding portion 228 extends into the space as a suspending tongue.

Figure 1:
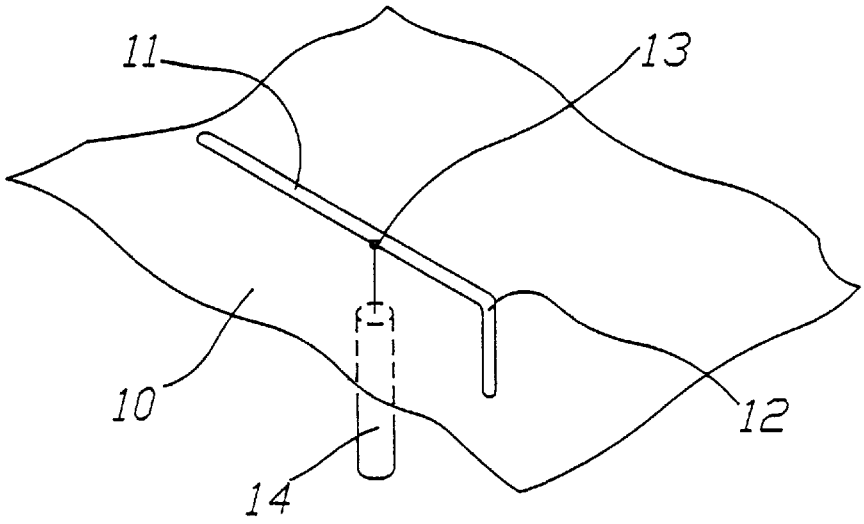
PRIOR ART FIG. 1
FIG. 1 is a perspective view of a conventional early planar inverted F-antenna.
Figure 2:
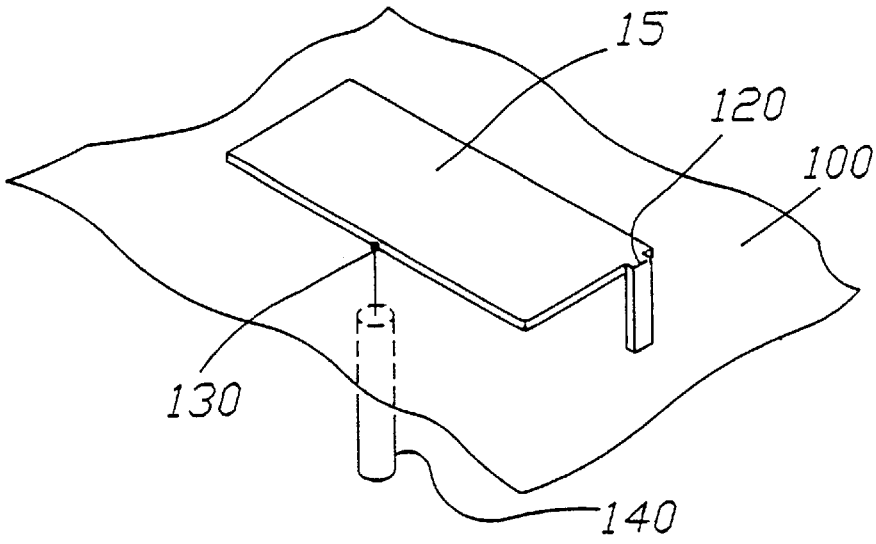
PRIOR ART FIG. 2
FIG. 2 is a perspective view of another kind of conventional planar inverted F-antenna.
Figure 3:
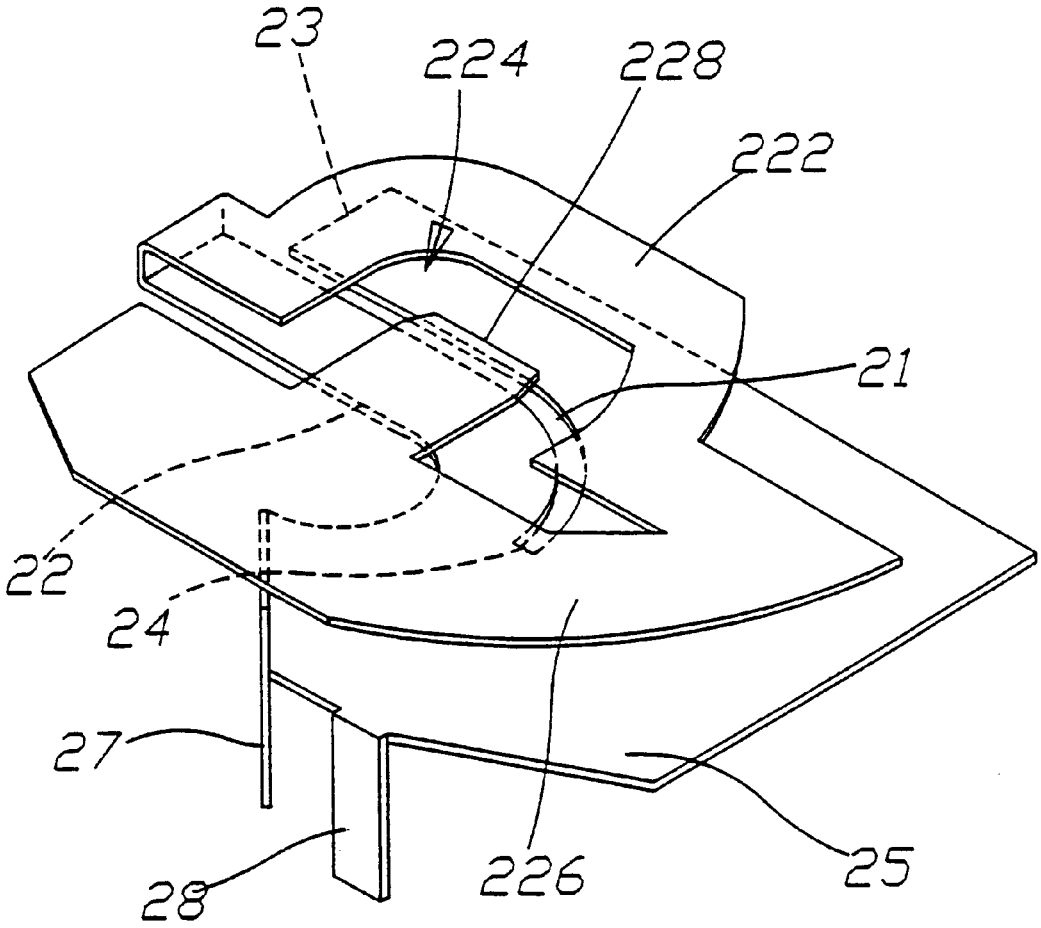
FIG. 3 is a perspective view showing the main body of the preferred embodiment of the present invention.

In order to decrease the horizontal length of the entire antenna, the entire unfolded antenna can be folded into the state as shown in FIG. 3.

The protruding portion 228 with the above structure thus forms an open stub to adjust bandwidth and impedance matching. This derivative function allows the bandwidth of the whole antenna to be enlarged in complying with need and a more desirable wideband antenna is formed accordingly.

Figure 5:
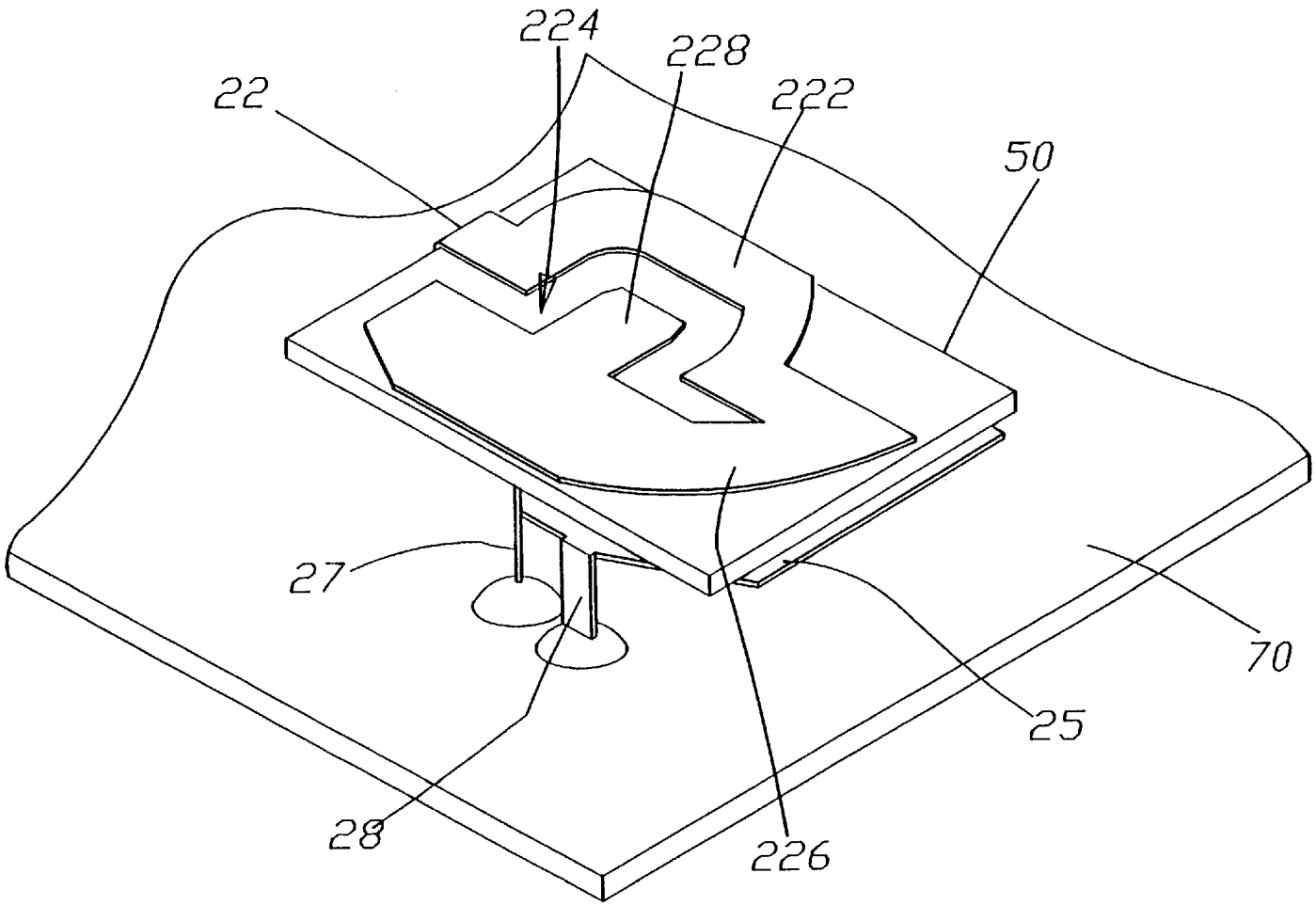
FIG. 5 is a schematic view showing the assembled state of the embodiment of FIG. 3.
Figure 6:
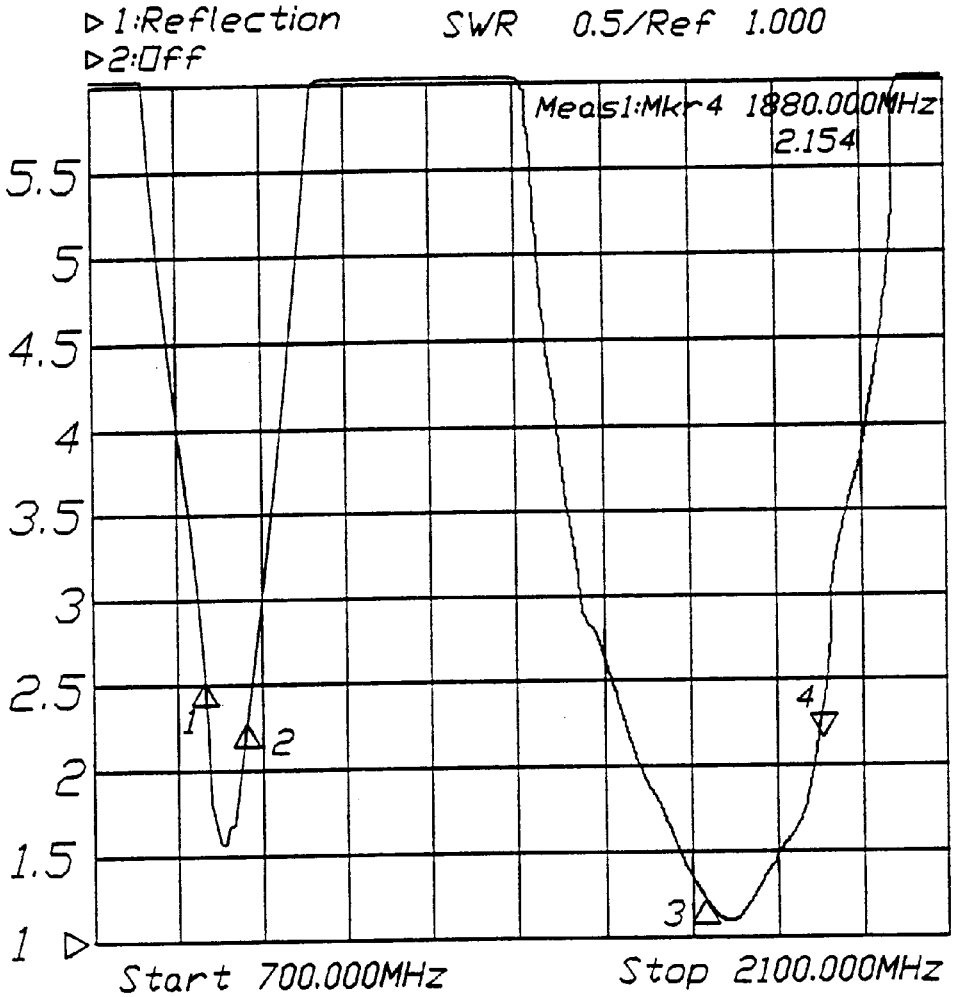
FIG. 6 is a testing chart of the embodiment of the present invention.

As shown in FIG. 5, when the present invention is applied to the interior of a set of communication equipment (such as a mobile phone), an insulating piece 50 can be provided in between the two parts of the folded sheet, then the contact pieces 27, 28 are linked to a given grounding surface 70.

While testing the embodiment of the present invention with the structure of the abovementioned modified hidden antenna, the standing wave voltage ratio (VSWR) is 2.538 at 880 MHz (point 1), 2.246 at 960 MHz (point 2), 1.350 at 1710 MHz (point 3) and 2.154 at 1880 MHz (point 4). The VSWR is between 1.35~2.538 which is quite desirable under the condition that this hidden antenna is built in.

Because that the bandwidth of the hidden antenna of the present invention can be increased further, it is especially suitable to be used as a dual- or multi-frequency built-in antenna on a set of communication equipment.

The above stated preferred embodiment is only for illustrating the present invention. It will be apparent to those skilled in this art that various modifications or changes can be made to the elements of the present invention and fall within the scope of the appended claims.

What is claimed is:

1. A hidden wideband antenna, said antenna is provided with an integrally shaped metal sheet, said metal sheet is provided with an open stub with predetermined length to partition it into a long section and a short section of a partial wavelength respectively of a plurality of predetermined resonant frequencies, a signal feed-in contact piece and a grounding contact piece are provided at one corner of the main sheet by punching; said hidden wideband antenna is characterized by:

an inwardly recessed section is provided along said long section to form a U-shape space, and a bent back section bent upwardly is provided at the outermost edge of said long section, said bent back section is provided with a protruding portion facing to said U-shape space of said inwardly recessed section and spaced therefrom with a predetermined distance in order to form an open stub.

2. A hidden wideband antenna as claimed in claim 1, wherein, said metal sheet is folded near the middle section thereof, and an insulating piece is placed in between the two parts thereof for installing it in the interior of a set of equipment.

3. A hidden wideband antenna as claimed in claim 1, wherein, said protruding portion is extended into said U-shape space in a suspending way to function as said open stub.

* * * * *